United States Patent [19]

Carmody

[11] 4,295,528

[45] Oct. 20, 1981

[54] SELECTIVE LOCK WITH SETTING AND RETRIEVING TOOLS

[75] Inventor: Michael Carmody, Houston, Tex.

[73] Assignee: Baker International Corporation, Orange, Calif.

[21] Appl. No.: 159,531

[22] Filed: Jun. 16, 1980

[51] Int. Cl.[3] ..... E21B 23/02

[52] U.S. Cl. ..... 166/315; 166/217

[58] Field of Search ..... 166/315, 708, 212, 214, 166/217, 237, 240

[56] References Cited

U.S. PATENT DOCUMENTS

| | | | |
|---|---|---|---|
| 2,862,560 | 12/1958 | Bostock et al. | 166/217 X |
| 3,288,493 | 11/1966 | Brown | 166/214 X |
| 3,507,329 | 4/1970 | Stone, Jr. | 166/217 |
| 3,670,821 | 6/1972 | Tamplen | 166/217 |
| 3,990,510 | 11/1976 | Decuir | 166/217 |

*Primary Examiner*—William F. Pate, III

*Attorney, Agent, or Firm*—William C. Norvell, Jr.

[57] ABSTRACT

A locking device and a method and apparatus are provided for emplacing the locking device within a selected one of a plurality of landing nipples positioned along a well conduit. Each nipple typically includes a seal bore portion having a bore diameter less than the conduit bore diameter and a recessed portion located above the seal bore having a diameter greater than the conduit bore diameter. The locking device includes a housing for retaining a plurality of circumferentially spaced expandable locking dogs. A camming sleeve is axially slidably within the housing and is utilized to support the dogs in one of three selected positions: a retracted position, a partially expanded no-go position, or a fully expanded locked position. The locking device is lowered down the well conduit on a running tool with the dogs in the retracted position until the running tool has passed through the seal bore of the nipple located directly above the selected landing nipple. The running tool is then pulled upwardly until a ratcheting portion of the running tool engages the seal bore portion of the nipple above the target nipple to set the locking dogs to the no-go position. The running tool and the locking device are then lowered further down the tubing until the locking dogs encounter the seal bore of the target landing nipple. At this time, the locking dogs are fully expanded to a locked position within the recessed portion of the target landing nipple. A retrieving tool also is provided.

20 Claims, 16 Drawing Figures

SELECTIVE LOCK WITH SETTING AND RETRIEVING TOOLS

BACKGROUND OF THE INVENTION

1. FIELD OF THE INVENTION

The present invention relates generally to downhole equipment for subterranean wells and in particular to a selective locking device, a running tool for emplacing the locking device at a selected location along a well conduit, and a retrieving tool for removal of the emplaced locking device.

2. DESCRIPTION OF THE PRIOR ART

Typically, a tubing string of a subterranean well is constructed with a plurality of landing nipples located at predetermined locations along the tubing. For example, landing nipples are incorporated into the tubing at locations where there is a present or future need for a well accessory such as a pressure equalization device or a flow control valve. These landing nipples are typically constructed with a restricted portion, or seal bore, having an inner diameter less than the inner diameter of the tubing, and a recessed portion, located above the restricted portion, with a diameter greater than the tubing diameter.

The well accessories are attached to a locking device which is subsequently lowered down the tubing and emplaced within a selected landing nipple by using a running tool. The running tool is connected to a conventional set of jars and wireline which are utilized to apply the requisite manipulative forces to the running tool for emplacing the locking device within the selected landing nipple.

Some prior art locking devices include expandable locking dogs which can be set to one of the three following positions: (1) a retracted position wherein the outside diameter of the dogs permit the locking device to pass down through the seal bore portions of each landing nipple; (2) a partially expanded, or no-go position wherein the dogs are expanded to enable the locking device to move through the tubing, but prevents the locking device from passing through the seal bore portion of a nipple; and (3) a fully expanded, or locked position, wherein the dogs are expanded within the recessed portion of a nipple to lock the device.

One method by which prior art locking devices are emplaced within a target landing nipple includes the steps of (1) lowering the running tool and locking device in the retracted position down the tubing through the target landing nipple; (2) pulling the running tool and locking device up through the target nipple to set the locking dogs to a no-go position; and (3) jarring down on the running tool to expand the dogs to a locked position within the recessed portion of the target nipple.

A prior art locking device which is set to the no-go position before reaching the target nipple is disclosed in U.S. Pat. No. 3,670,821 to Tamplen. In the Tamplen apparatus, the running tool and the locking device are run down the the tubing with the locking dogs in the retracted position until the locking device is positioned just above the target landing nipple. The running tool is then manipulated via a wireline and a set of jars to set the dogs of the locking device to a no-go position. The locking device is then lowered to locate in the target nipple where the dogs are expanded to a locked position as the running tool is pulled upwardly to retrieve the tool from the tubing.

SUMMARY OF THE INVENTION

The present invention provides a method and apparatus for setting the dogs of a well locking device to a no-go position. In accordance with the present invention, the locking device is lowered down the tubing or other conduit within the well on a running tool with the dogs in the retracted position until the running tool has passed through the seal bore of the nipple located directly above the target landing nipple. The running tool is then pulled upwardly until a ratcheting portion of the running tool engages the seal bore portion of the nipple above the target nipple to set the locking dogs to the no-go position. The running tool and the locking device are then lowered further down the tubing until the locking dogs encounter the seal bore of the target landing nipple. At this time, the locking dogs are expanded to a locked position within the recessed portion of the target landing nipple.

The locking device includes a primary annular housing having a plurality of circumferentially spaced windows. A plurality of axially extending locking dogs having enlarged lower end portions are respectively aligned with the windows of the housing. The dogs are mounted within the housing in a manner which permits the enlarged portions to move through the windows to project radially beyond the housing. A camming sleeve is axially slidable within the housing and has three axially spaced external cylindrical cam surfaces selectively engagable with the dogs for supporting the dogs in one of three positions: a retracted position; a partially expanded no-go position; or a fully expanded locked position. The camming sleeve has a plurality of peripherally spaced, resilient fingers having enlarged upper end portions for detachable engagement by a running tool to control the vertical position of the camming sleeve.

The running tool which is used to emplace the locking device within a selected nipple includes an upper fishing neck portion and a lower body portion insertable within the camming sleeve of the locking device. The lower body portions has an annular recess formed therein engagable with the enlarged end portions of the resilient fingers of the locking device. The fishing neck portion and the lower body portion are interconnected by means responsive to jarring forces applied to the fishing neck to cause the lower body to pull the camming sleeve upwardly by the enlarged end finger portions to set the dogs to a no-go position, then to a locking position, and then to release the enlarged finger end portions from the lower body recess to permit pulling of the running tool. The running tool remains secured to the locking device until the camming sleeve has been set to a fully locked position.

A retrieving tool for unlocking and removing the locking device from the well tubing includes a downwardly facing shoulder on its lower end to engage and depress the camming sleeve to its retracted position relative to the locking dogs. A plurality of collet fingers are peripherally spaced around the lower end of the retrieving tool. The collet fingers are engagable with a downwardly facing shoulder formed on the upper end of annular housing of the locking device to secure the retrieving tool to the device such that the entire assembly may be pulled up the tubing.

DESCRIPTION OF THE PREFERRED EMBODIMENTS

Figure 1:
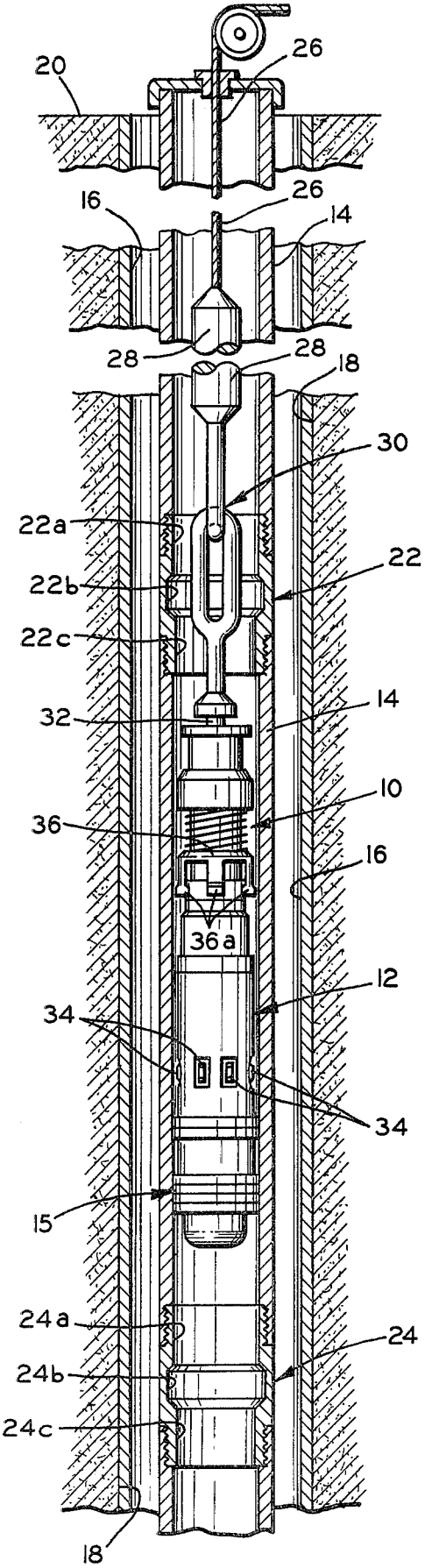
FIG. 1 is a schematic diagram of a running tool and a locking device according to the present invention as they are lowered down a tubing string of a subterranean well.

Referring to FIG. 1, there is shown a running tool 10 and a selective locking device 12 according to the present invention which are being lowered through a tubing string 14. The locking device 12 is utilized to position a suitable tool, such as a safety control valve 15, at a selected location in the tubing string 14. The tubing string 14 is suspended in a well casing 16 which has been positioned in a previously drilled subterranean bore hole 18.

Although not shown in FIG. 1, the tubing string 14 extends downwardly and is in fluid communication with a production zone of a subterranean well. The tubing string 14 and the well casing 16 extend upwardly to the surface 20.

Generally, a tubing string has a plurality of landing nipples positioned at predetermined locations along the tubing string. In FIG. 1, two such landing nipples are shown in the tubing string 14, an upper landing nipple 22 and a lower landing nipple 24. The upper landing nipple 22 includes an upper annular portion 22*a* having an inner diameter substantially equal to the inner diameter of the tubing 14. A recessed portion 22*b* is located directly below the annular portion 22*a* and has an inner diameter larger than that of the tubing 14. A restricted portion or seal bore 22*c* is formed in the lower end of the nipple 22 and has an inner diameter smaller than that of the tubing 14, thus defining a restriction.

The lower landing nipple 24 is essentially identical to the upper nipple 22. The lower nipple 24 includes an upper annular portion 24*a*, a recessed portion 24*b* and a lower seal bore or restricted portion 24*c*, all having inner diameters substantially equal to the diameters of the upper nipple portions 22*a*, 22*b*, and 22*c* respectively.

The running tool 10, the locking device 12, and the safety vavle 15 are lowered through the tubing 14 by means of a conventional wireline 26 or by other conventional means, this invention not being limited to use with wireline-carried mechanisms. The extreme lower end of the wireline 26 is connected to a stem weight 28 having a lower end connected to a set of jars 30. The jars 30 have a lower end connected to a fishing neck portion 32 formed on the upper end of the running tool 10. The wireline 26, the stem weight 28, and the jars 30 are utilized to manipulate the running tool so as to control the position of a plurality of locking dogs 34, circumferentially spaced around the locking device 12.

Initially, the locking dogs 34 are in a fully retracted, or "run" position. When in the run position, the running tool 10 and the locking device 12 can be lowered down through the tubing string 14 and pass through the seal bore portion of each landing nipple.

The running tool 10 and the locking device 12 are run down through the tubing string 14 until they have passed through the seal bore of the nipple located immediately above the landing nipple in which it is desired to lock the device 12. For example, if it is desired to set the locking device 12 in the lower landing nipple 24 of FIG. 1, the running tool 10 and the locking device 12 would be lowered down the tubing string 14 until they have passed through the seal bore 22*c* of the landing nipple 22. Now, the dogs 34 of the locking device 12 are set to a partially expanded, or "no-go" position. When in the no-go position, the dogs 34 are expanded to a position which enables the locking device 12 to move further down the tubing string 14, but prevents the dogs 34 from passing through the seal bore 24*c* of the target landing nipple 24. Thus, the locking device will "no-go" at the constriction defined by the seal bore 24*c* of the target landing nipple 24.

As shown in FIG. 1, the running tool 10 is provided with a ratcheting means or collet 36 having a plurality of circumferentially spaced dogs 36*a* formed on the lower end thereof. The running tool 10 permits the dogs 36*a* to pass downward through the seal bore portions of the nipples, but prevents the dogs 36*a* from being pulled up through a seal bore unless the running tool 10 has been set to the retrieve position. After the running tool 10 and the locking device 12 have passed through the seal bore 22*c* of the nipple 22 immediately above the target landing nipple 24, the wireline 26 is manipulated to pull the running tool 10 and the locking device 12 back up the tubing string 14. When the dogs 36*a* of the collet 36 engage the lower shoulder of the constricted seal bore 22*c*, the running tool 10 is prevented from any further upward movement. Now, additional upward force applied by the wireline 26 causes the dogs 34 of the locking device 12 to be set to a no-go position. The running tool 10 and the locking device 12 are then run down the tubing string 14 until the dogs 34 no-go at the upper shoulder lip of the seal bore 24*c*.

The dogs 34 of the locking device 12 are now set to a fully expanded, or locked position. The locked position in is achieved by jarring down with jars 30 to release the running tool 10 from the locking device 12, and then by pulling up on the running tool 10 to cause the dogs 34 to be moved to a fully expanded, locked position within the recessed portion 24*b* of the target landing nipple 24.

THE RUNNING TOOL AND THE LOCKING DEVICE

Figures 2A, 3A, 4A, 5A:
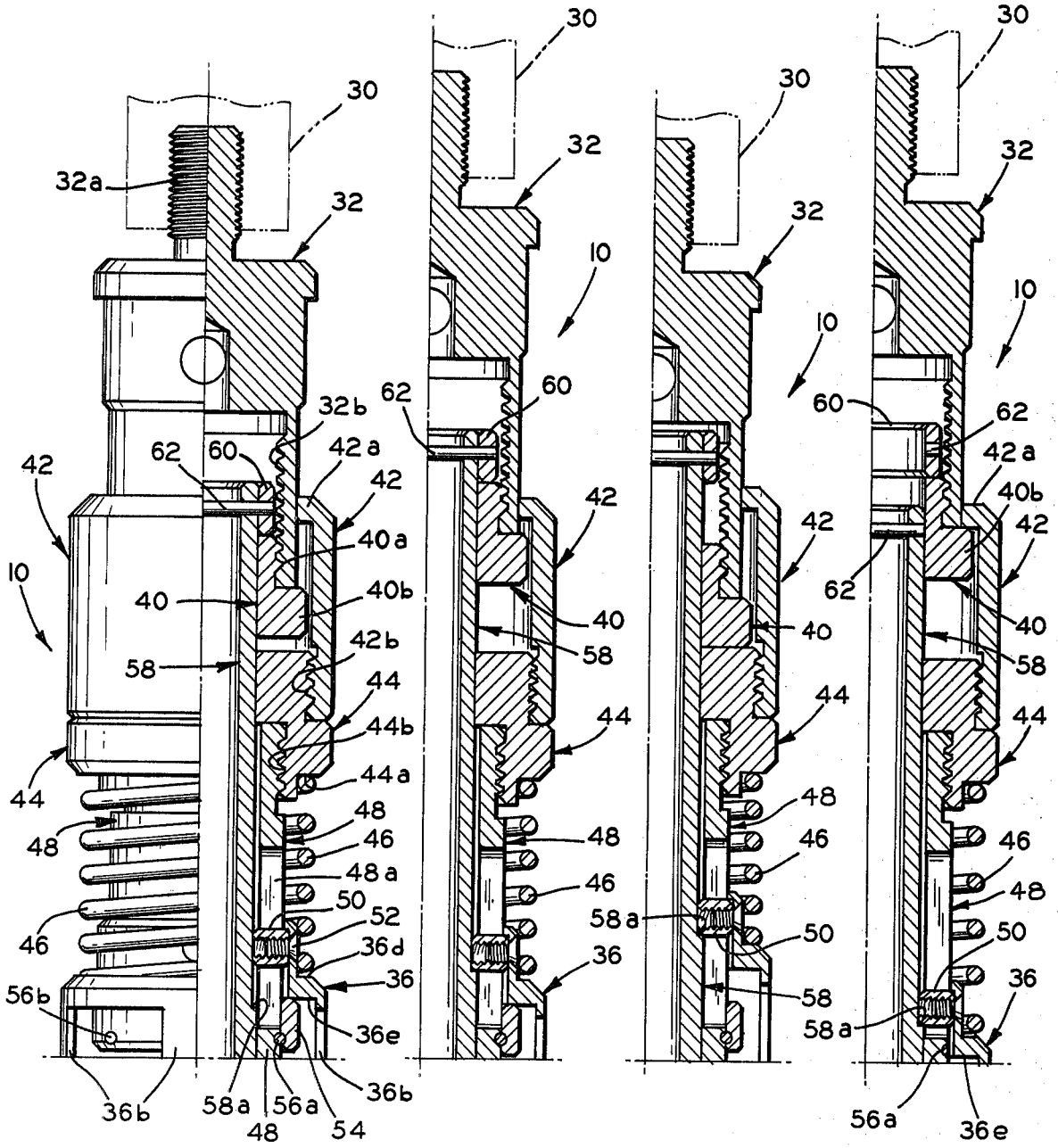
FIGS. 2*a* to 2*c* together constitute an elevational view, partly in section, illustrating the running tool and the locking device in the run position wherein the locking dogs of the locking device are fully retracted, FIGS. 2*b* and 2*c* respectively being vertical continuations of FIGS. 2*a* and 2*b*.
FIGS. 3*a* to 3*c* together constitute a sectional view, similar to FIGS. 2*a* to 2*c*, but showing the relative positions of the components of the running tool and the locking device when the locking dogs have been set to a no-go position, FIGS. 3*b* and 3*c* respectively being vertical continuations of FIGS. 3*a* and 3*b*.
FIGS. 4*a* to 4*c* together constitute a sectional view, similar to FIGS. 3*a* to 3*c*, but showing the relative positions of the components of the running tool and the locking device when the tool is released from the locking device and is in position to set the locking dogs to a locked position, FIGS. 4*b* and 4*c* respectively being vertical continuations of FIGS. 4*a* and 4*b*.
FIGS. 5*a* to 5*c* together constitute a sectional view, similar to FIGS. 3*a* to 3*c*, illustrating the running tool and the locking device in an emergency retrieve position wherein the locking dogs have been moved from a no-go to a retracted position such that the entire assembly may be retrieved up the tubing, FIGS. 5*b* and 5*c* respectively being vertical continuations of FIGS. 5*a* and 5*b*.
Figures 2B, 3B, 4B, 5B:
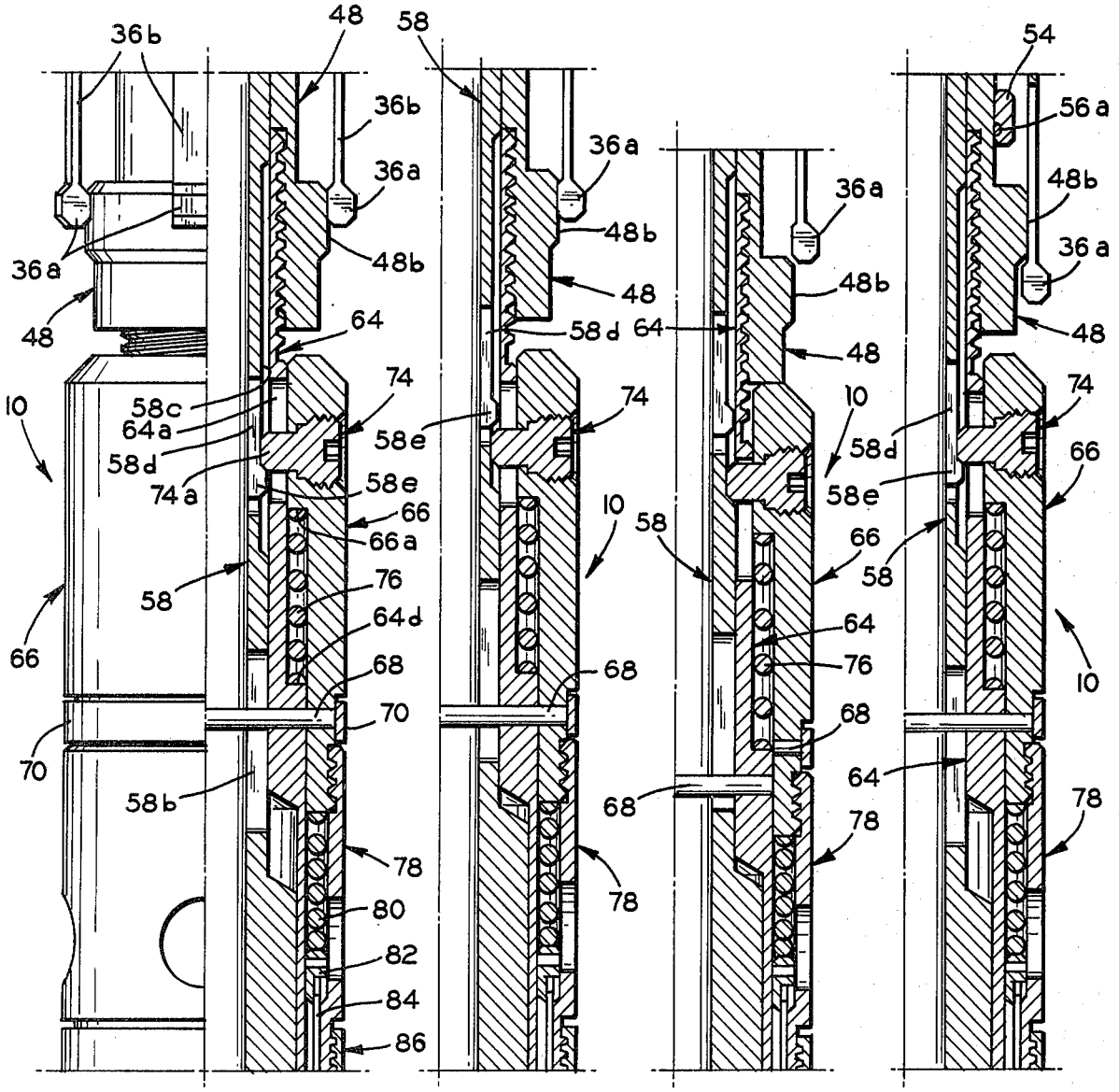
Figures 2C, 3C, 4C, 5C:
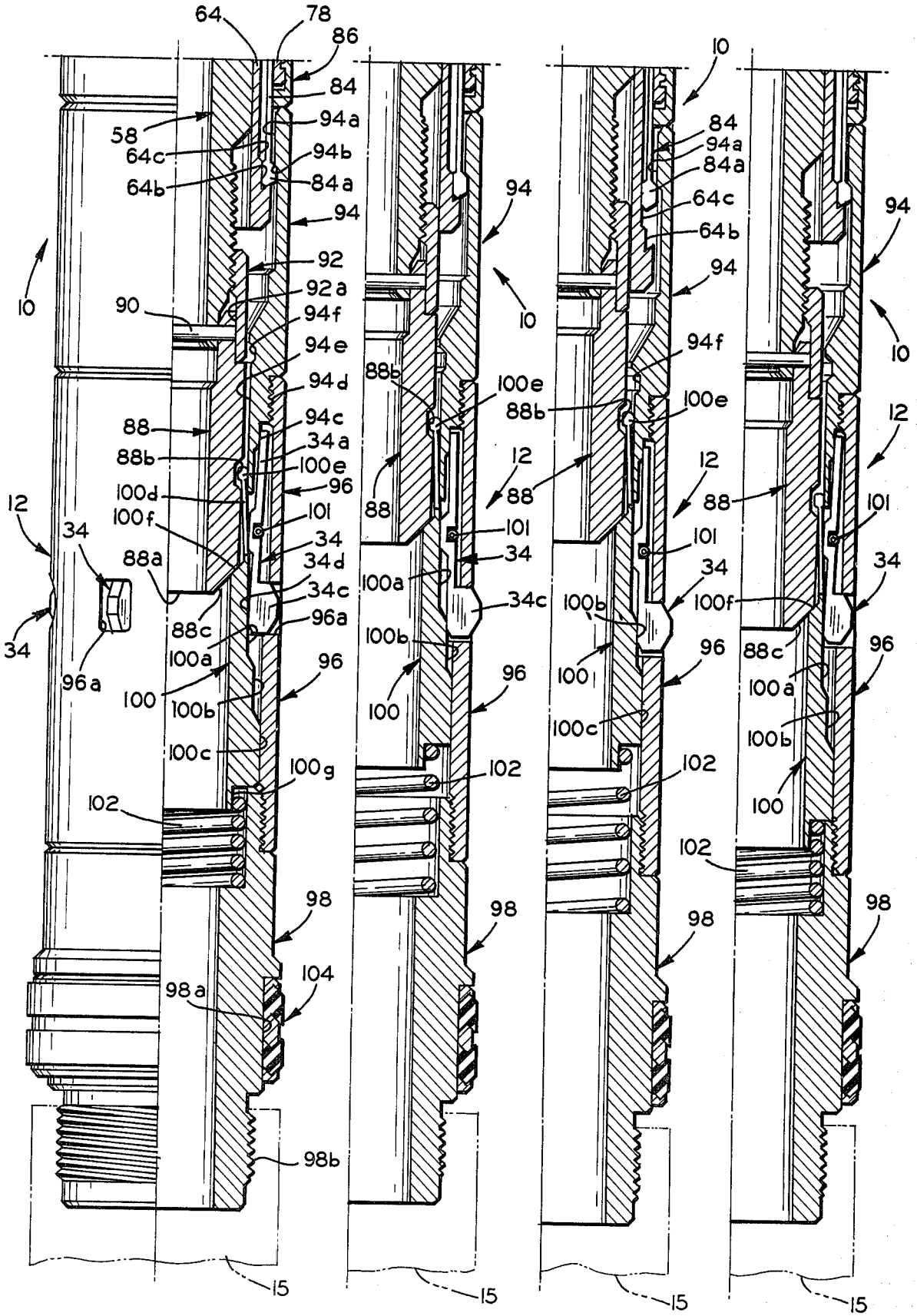

FIGS. 2*a* to 2*c* illustrate the running tool 10 and the locking device 12 in the run position. In this position, the dogs 34 of the locking device 12 are fully retracted such that the locking device may be lowered down the tubing string through the seal bore portion of each nipple.

As shown in FIG. 2*a*, the fishing neck 32 of the running tool 10 has an upper externally threaded portion 32*a* for connecting the tool 10 to the jars 30. The lower portion of the neck 32 has a cylindrical cavity with internal threads 32*b* formed therein for engaging external threads 40*a* formed on the upper end of a stop ring 40. The stop ring 40 has a lower annular shoulder 40*b* for permitting limited longitudinal movement of the fishing neck 32 relative to a stop ring housing 42. The stop ring housing 42 has an inner annular shoulder 42*a* formed on the upper end thereof, and a lower threaded portion 42*b* threaded onto a spring retainer 44.

The spring retainer 44 includes an outer annular notch 44*a* formed on the lower end thereof for providing an upper seat for a helical compression spring 46. The spring retainer 44 has a lower internally threaded portion 44*b* threaded onto a collet mandrel 48.

The collet mandrel 48 extends downwardly and has a plurality of circumferentially spaced, vertical slots 48*a* formed therein (only one of which is shown in FIG. 2*a*). A collet or detent support ring 36 circumscribes the mandrel 48 and includes downwardly extending arms 36*b*. As shown in FIG. 2*b*, the dogs or detents 36*a* are formed on the extreme lower ends of the arms 36*b*. The collet 36 is securely connected to a plurality of segments 50 (only one of which is shown in FIG. 2*a*) by threaded fasteners 52. Each segment 50 is slidably mounted within a respective one of the vertical slots 48*a* to permit longitudinal movement of the collet 36 relative to the mandrel 48.

The collet 36 has an annular shoulder 36*d* which provides the lower seat for the spring 46. The spring 46 urges the collet downwardly such that a lower surface 36*e* abuts an annular shear sleeve 54 which has been secured to the mandrel 48 by a pair of shear pins 56*a* and 56*b* which are tangentially positioned relative to the mandrel 48.

A locating sleeve or inner positioning sleeve 58 is circumferentially carried and slidable within the collet mandrel 48. The sleeve 58 extends upwardly into the fishing neck 32 and has an annular slip ring 60 secured around the upper end thereof by a diametrically positioned shear pin 62. The upper portion of the sleeve 58 is of a reduced diameter which terminates at its lower end in an annular shoulder portion 58*a*.

As shown in FIG. 2*b*, the mandrel 48 has an outer annular cam means or enlarged portion 48*b* formed on the lower end thereof for maintaining the outer surface of the dogs 36*a* at a diameter less than that of the tubing string 14, but greater than the diameter of the seal bore portion of the landing nipples.

When the running tool 10 is being run down the tubing 14, the dogs 36*a* will engage the upper lip of the seal bore of a landing nipple and the collet 36 will be urged upwardly to compress the spring 46 and move the dogs 36*a* off the raised portion 48*b*. The dogs 36*a* will collapse and permit the tool to pass through the seal bore of the nipple. However, when the tool 10 is moved upwardly to set the locking device 12 to a no-go position, the dogs 36*a* engage the lower lip of the seal bore of the nipple above the target nipple. Since the collet 36 is prevented from moving downwardly by the engagement of the lower surface 36*e* with the shear sleeve 54, the dogs 36*a* will remain on the raised portion 48*b* such that the tool 10 cannot be pulled past the seal bore portion. Hence, the dogs or detents 31*a* function as a unidirectional ratchet mechanism. The spring retainer 44 and collet mandrel 48 are hereinafter collectively called a "ratchet housing".

The lower end of the collet mandrel 48 is threaded onto the upper end of an inner mandrel 64. A spring housing 66 is circumferentially positioned around the inner mandrel 64. The housing 66 and mandrel 64 are secured together by means of a diametrically positioned shear pin 68 which is held in position by a circumferential retainer ring 70. The shear pin 68 extends through vertical slots 58*b* formed in the locating sleeve 58 which permit independent longitudinal movement of the sleeve 58 relative to the inner mandrel 64.

A plurality of circumferentially spaced apart locating pins 74 (only one of which is shown in FIG. 2*b*) are threaded into the side wall at the upper end of the spring housing 66. Each of the pins includes a radial projection 74*a* which extends inwardly through a vertical slot 64*a* formed in the inner mandrel 64. The radial projection 74*a* extends past the inner wall of the mandrel and is slidable along a reduced diameter portion 58*c* in the locating sleeve 58. A plurality of circumferentially spaced apart collet fingers 58*d* (only one of which is shown in FIG. 2*b*) are formed in the locating sleeve 58 to correspond with the locating pins 74. The lower end of the fingers 58*d* has an outer raised shoulder 58*e* formed thereon. The locating pins 74 and the collet fingers 58*d* control the position of the locating sleeve 58 relative to the locking device 12 in order to manipulate the position of the locking dogs 34. For example, when the locating pin 74 is positioned above the shoulder 58*e*, as shown in FIG. 2*b*, the position of the locating sleeve 58 is such that the dogs 34 of the locking device are fully retracted. However, when the locating pins 74 are moved below the shoulder portion 58*e*, the locating sleeve 58 will cause the dogs 34 of the locking device 12 to be in a partially expanded, or no-go position.

The inner mandrel 64 and the spring housing 66 cooperate to form an annular hollow portion for retaining a helical compression spring 76. The upper end of the spring 76 seats against an annular shoulder 66*a* formed in the housing 66, while the lower end seats on an annular shoulder 64*d* formed in the mandrel 64. It should be noted that, as long as the pin 68 is not sheared, any longitudinal movement of the inner mandrel 64 will be transferred to the spring housing 66, and vise versa. However, when the pin 68 is sheared to retrieve the running tool, the spring 76 urges the inner mandrel 64 downwardly to release the running tool 10 from the locking device 12.

The lower end of the spring housing 66 is threaded into the upper end of a lower housing 78. The outer wall of inner mandrel 64 and the inner wall of the lower housing 78 cooperate to house a helical compression spring 80. The upper end of the spring 80 seats against the extreme lower end of the spring housing 68, while the lower end of the spring 80 seats on an annular dog retainer ring 82. The ring 82 is slidable along the inner wall of the housing 78 and is biased downward by the spring 80. The ring 82 houses the upper ends of a plurality of circumferentially spaced apart dogs 84 having enlarged portions 84*a* formed on the lower end thereof.

As shown in FIGS. 2*b* and 2*c*, an adjustment ring 86 is threaded onto the lower end of the housing 78. The adjustment ring 86 is utilized to take out any tolerances between lower housing 78 and the uppermost end of the locking device 12 when the running tool 10 and the locking device 12 are initially secured together.

The locking device, generally indicated by number 12, is shown in FIG. 2*c*, along with the lowermost portion of the running tool 10. The extreme lower end of the locating sleeve 58 is secured within the upper end of a cylindrical lower body 88. A diametrically located shear pin 90 extends through the lower body 88 and the locating sleeve 58. A locking ring 92 is threadedly secured to the lower end of sleeve 58 and includes an inner annular surface 92*a* which circumscribes the upper end of the lower body 88 to retain the shear pin 90 in position. The extreme lower end of the body 88, generally indicated by numeral 88*a*, defines the lowermost portion of the running tool 10.

The locking device 12 includes an upper fishing neck portion 94 having an inner annular downwardly facing shoulder 94*a* formed on the upper end thereof. The shoulder 94*a* has a lower lip 94*b* which engages the enlarged portions 84*a* of the dogs 84. The enlarged portions 84*a* are held in engagement with the lower lip 94*b* by an upwardly facing stepped surface 64*b* formed on the lower end of the inner mandrel 64. The surfaces 64*b* and 94*a* thus effectively define an annular locking recess within which the enlarged dog portions 84*b* are trapped to lock the running tool 10 to the locking device 12. The inner mandrel 64 includes a reduced diameter portion 64*c* immediately above the stepped surface 64*b*. When it is desired to release the running tool 10 from the locking device 12, the inner mandrel 64 is forced downwardly such that the enlarged portions 84*a* of the dogs 84 will rest on the reduced diameter portion 64*c* so that they may be moved upward past the inner shoulder 94*a*.

The plurality of locking dogs 34 are circumferentially spaced around the locking device 12. The lower end of the fishing neck 94 has an annular raised surface 94*c* formed thereon for supporting an upper arm 34*a* of each locking dog 34. Each of the dogs 34 has an enlarged lower end 34*c* formed thereon which extend into a respective one of a plurality of windows or apertures 96*a* formed in the side wall of a latching mandrel 96. The upper end of the latching mandrel 96 is threaded onto an intermediate portion 94*d* of the fishing neck 94. The lower end of the mandrel 96 is threaded onto the upper end of a packing mandrel 98.

The locking device 12 includes a plunger 100 for manipulating the dogs 34 from a retracted position to a no-go position and then to an expanded position. An annular garter spring 101 is carried within an outer groove formed in each arm 34*a* to hold an inner surface 34*d* of the dogs 34 against the plunger 100. The plunger 100 has three annular stepped surfaces of varying diameters to control the position of the dogs 34.

As shown in FIG. 2*c*, the dogs are in the run or retracted position wherein the inner surface 34*d* of the dog 34 is resting on a first annular upper stepped surface 100*a*. A second annular stepped surface of increased diameter 100*b* is located below the first surface 100*a*. When the inner surface 34*d* of the dogs 34 are resting on the second surface 100*b*, the dogs 34 are partially expanded and the locking device 12 is in the no-go position (FIG. 3*c*). The third annular stepped surface 100*c* is formed below the second stepped surface 100*b* and is of a greater diameter than the second stepped surface. The locking device 12 is in the fully locked position and the dogs 34 are fully expanded into engagement with nipple recess 24*b* when the inner surface 34*d* of the dogs are resting on the third stepped surface 100*c*.

The plunger 100 includes a plurality of upwardly extending collet fingers 100*d* each having an enlarged upper end portion 100*e*. An outer annular groove 88*b* is formed in the lower body 88 for receiving the upper end portions 100*e*. The collet fingers 100*d* are longitudinally slidable with the lower body 88 along an inner annular wall 94*e* formed in the lower end of the fishing neck 94. The longitudinal position of the plunger 100 is controlled by the longitudinal movement of the locating sleeve 58 and lower body 88.

Upward movement of the lower body causes the lower lip of the groove 88*b* to engage the enlarged upper ends 100*e* of collet fingers 100*d* to pull the plunger 100 upwardly. Downward movement of the lower body 88 is transferred to the plunger 100 by the engagement of a lower tapered portion 88*c* of the body 88 with an upper tapered surface 100*f* of the plunger 100.

The fishing neck 94 has an inner annular groove 94*f* formed at the top of the inner annular wall 94*e* for limiting the upward movement of the plunger 100. When the lower body 88 has pulled the plunger upwardly to where the upper ends 100*e* of the collet fingers are received into the annular groove 94*f*, the dogs 34 will be fully expanded in the locked position and the lower body 88 can be lifted from the locking device 12.

The upper end of the packing mandrel 98 houses a helical compression spring 102 having an upper end which seats in an outer annular notch 100*g* formed in the lower end of the plunger 100. The spring 102 exerts an upward force on the plunger 100 to hold the plunger underneath the dogs 34 after the running tool 10 has been retrieved from the tubing string. A conventional packing element 104 is positioned over an intermediate cylindrical portion 98*a* of the mandrel 98. The lowermost end of the mandrel has external threads 98*b* formed thereon to which a suitable tool, such as the safety valve 15, may be attached.

OPERATION OF THE RUNNING TOOL AND THE LOCKING DEVICE

FIGS. 2*a* to 2*c* illustrate the running tool 10 and the locking device 12 in the run position. In this position, the locating sleeve 58 is positioned such that the raised shoulder 58*e* is below the locating pin 74, as shown in FIG. 2*b*. This causes the lower body 88 to position the plunger 100 such that the dogs 34 are resting on the first annular stepped surface 100*a*, as shown in FIG. 2*c*. Thus, in the run position, the dogs 34 are fully retracted within the mandrel 96 and the locking device 12 may be lowered down the tubing conduit through the seal bore portion of each nipple without contacting the side walls of the casing or other landing nipples.

The running tool 10 and the locking device 12 are lowered down the tubing string until they have passed through the seal bore of the landing located immediately above the target landing nipple. At this time, the dogs 34 of the locking device 12 are set to a no-go, or partially expanded, position.

Now referring to FIGS. 3*a* to 3*c*, the locking device 12 is set to a no-go position by pulling the running tool 10 up the tubing string until the dogs or detents 36*a* of the collet 36 engage the lower lip of the seal bore of the nipple above the target nipple. This prevents the running tool from moving further up the tubing. Additional upward force is then applied to the fishing neck 32 such that the extreme upper end of the stop ring 40 abuts the lower end of the retainer ring 60. This additional upward force causes the collet fingers 58*d* of the locating sleeve 58 to momentarily collapse as the locating pin 74 is pulled above the raised shoulder 58*e*, as shown in FIG. 3*b*. As the lower body 88 is pulled upwardly with the sleeve 58, the annular groove 88*b* engages the enlarged upper end portions 100*e* of the plunger 100 to pull the plunger upwardly. This causes the second annular stepped surface 100*b* of the plunger to move underneath the dogs, as shown in FIG. 3*c*. When the dogs 34 are resting on the second stepped surface 100*b*, they are partially expanded and the outer diameter of lower ends 34*c* is less than the diameter of the tubing string, but greater that the seal bore portion of the target landing nipple.

Next, the running tool 10 and the locking device 12 are run down the tubing until the dogs 34 of the locking device 12 no-go at the lower lip of the locking recess 24*b* of the target nipple. The running tool 10 is released from the locking device 12 and the dogs 34 are moved to a fully expanded position within the recessed portion 24*b* of the target landing nipple.

FIGS. 4*a* to 4*c* illustrate the running tool 10 in a released position. In order to release the running tool 10 from the locking device 12, the jars 30 are manipulated to jar down on the fishing neck 32 such that the lower surface of the stop ring 40 abuts the upper end of the spring retainer 44, as shown in FIG. 4*a*. The jarring down force on the spring housing 44 is transferred through the collet mandrel 48 to the inner mandrel 64. This causes the shear pin 68 to shear, as shown in FIG. 4*b*, such that the inner mandrel 64 is moved downwardly by the biasing spring 76. When the inner mandrel 64 is moved downwardly, the enlarged portions 84*a* of the dogs 84 will move off the stepped surface 64*b* and collapse against the reduced diameter portion 64*c* of the inner mandrel 64, as shown in FIG. 4*c*. The running tool 10 is now released from the locking device 12 since the enlarged portions 84*a* can be pulled upwardly past the inner shoulder 94*a* of the locking device. It should also be noted that the downward movement of the inner mandrel 64 pulls the raised portion 48*b* of the collet mandrel 48 below the dogs 36*a*, as shown in FIG. 4*b*, such that the running tool can easily be pulled up through the seal bore portions of the nipples.

As the running tool 10 is pulled upwardly, the annular groove 88*b* of the lower body 88 engages the upper end portions 100*e* of the plunger 100 to pull the plunger upwardly. This causes the third annular stepped surface 100*c* of the plunger to move underneath the dogs 34. When the dogs 34 are resting on the third stepped surface 100*c*, they are fully expanded and the locking device 12 is secured within the annular recess 24*b* of the target landing nipple.

When the lower body has pulled the plunger upwardly to where the upper end portions 100*e* seat in the annular groove 94*f*, the plunger 100 is at its uppermost position and the lower body 88 can be lifted past the enlarged portions 100*e*. The plunger is then held in position by the biasing spring 102.

One important feature of the present invention is that the dogs 34 of the locking device 12 must be in a fully expanded position before the entire running tool 10 can be retrieved. This feature is accomplished by requiring the lower body 88 to pull the plunger 100 to its uppermost position and fully expand the dogs 34 before the lower body 88 can be lifted from the locking device 12. However, in some instances, it may not be possible to lift the entire running tool 10 from the locking device 12 after the lock is set in the recessed groove of the nipple as when, for example, the dogs 34 can not be moved to a fully expanded position because of foreign material build-up in the recessed groove of the nipple. In these instances, the running tool 10 may be retrieved from the tubing by jarring up on the fishing neck 32 to exert an upward force on the locating sleeve 58 to shear the shear pin 90 and release the locating sleeve 58 from the lower body 88. The running tool 10, except for the lower body 88, can then be retrieved from the tubing. The lower body 88 would remain downhole in the locking device 12.

Another position which the running tool 10 may be required to assume is the emergency retrieve position, and is illustrated in FIG. 5*a* to 5*c*. Generally, once the locking device 12 has been set to a no-go position, the locking device 12 can easily be lowered down the tubing until the lock seats on the upper lip of the seal bore of the target nipple. However, in some instances, a restriction may be present in the tubing which prevents the locking device from reaching the target nipple. It is in this instance when the running tool 10 and the locking device 12 is set to the emergency retrieve position, such that both the tool 10 and device 12 can be retrieved from the tubing.

In order to set the running tool 10 and the locking device 12 to the emergency retrieve position, the running tool 10 is pulled back up the tubing until the dogs 36*a* of the collet 36 contact the seal bore of the nipple above the target nipple. The jars 30 are then utilized to jar up on the fishing neck 32 to apply an upward force to the retainer ring 60 and shear the pin 62. The fishing neck can then move further upwardly within the stop ring housing 42 such that the outer annular shoulder 40*b* abuts the inner annular shoulder 42*a*, as shown in FIG. 5*b*. The upward jarring is then continued to force the shear sleeve 54 upward against the lower surface 36*e* of the collet 36. This causes the tangential shear pins 56*a* and 56*b* to shear, and the sleeve slides down the collet mandrel 48, as shown in FIG. 5*a* and 5*b*. Once the pins 56*a* and 56*b* are sheared, the spring 46 exerts a downward force on the collet which, in turn, applies the downward force to the locating sleeve 58 by the engagement of the segments 50 with the shoulder 58*a*. The downward force causes the dogs 36*a* to slide down the mandrel 48 and off the raised portion 48*b*. The dogs 36*a* are now collapsed such that they can be pulled upwardly through the constricted seal bore portions of the nipples.

The downward force applied to the locating sleeve 58 by the segments 50 urges the shoulder 58*e* to a position below the locating pin 74, while concurrently forcing the plunger 100 downwardly by the engagement of the lower body tapered portion 88*c* with the tapered surface 100*f*. When the plunger is moved downwardly, the dogs 34 will move from the no-go position on the second stepped surface 100*b* to the retracted position on the first stepped surface 100*a*, as shown in FIG. 5*c*. At this time, the running tool 10 and the locking device 12 can be rapidly retrieved up the tubing.

ALTERNATE EMBODIMENT OF THE RUNNING TOOL

Figure 6:
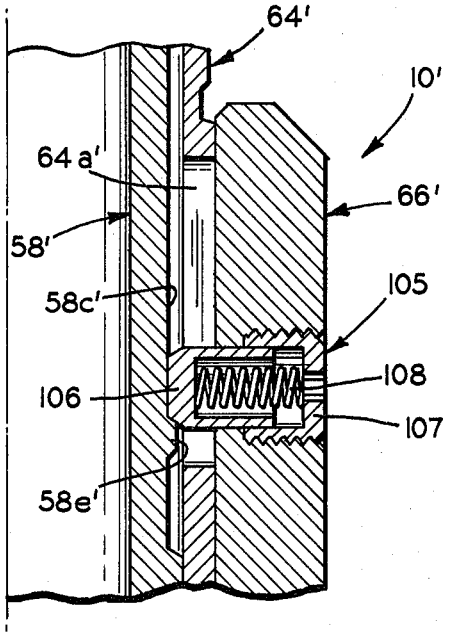
FIG. 6 is a sectional view of an alternate embodiment of a portion of the running tool shown in FIG. 2*b*.

There is shown in FIG. 6 an alternate embodiment 10' for a portion of the running tool 10. Basically, in the embodiment illustrated in FIG. 6, a spring biased locating pin assembly 105 is utilized to replace the one piece locating pin 74 shown in FIG. 2*b*. This permits the locating sleeve 58 to be constructed without the collet fingers 58*d* shown in FIG. 2*b*.

As shown in FIG. 6, a locating pin 106 is slidable within a cap member 107 threaded into the side wall of a spring housing 66'. A biasing helical compression spring 108 is carried within cylindrical cavities formed in the pin 106 and the cap member 107. The spring 108 urges the locating pin 106 radially inwardly through a vertical slot 64*a'* in an inner mandrel 64' and against a reduced diameter portion 58*c'* of a locating sleeve 58'. The locating sleeve 58' has an outer raised annular shoulder 58*e'* formed thereon for controlling the position of the locating sleeve 58' relative to the locking device.

The portion of the running tool 10' shown in FIG. 6 operates in a manner similar to locating pin arrangement shown in FIG. 2*b*. For example, when the locating pin 106 is positioned above the shoulder 58*e'* as shown in FIG. 6, the dogs of the locking device are in the retracted position. When the pin 106 is below the shoulder 58*e'*, the dogs of the locking device are in a no-go position.

THE RETRIEVING TOOL

Figure 7A:
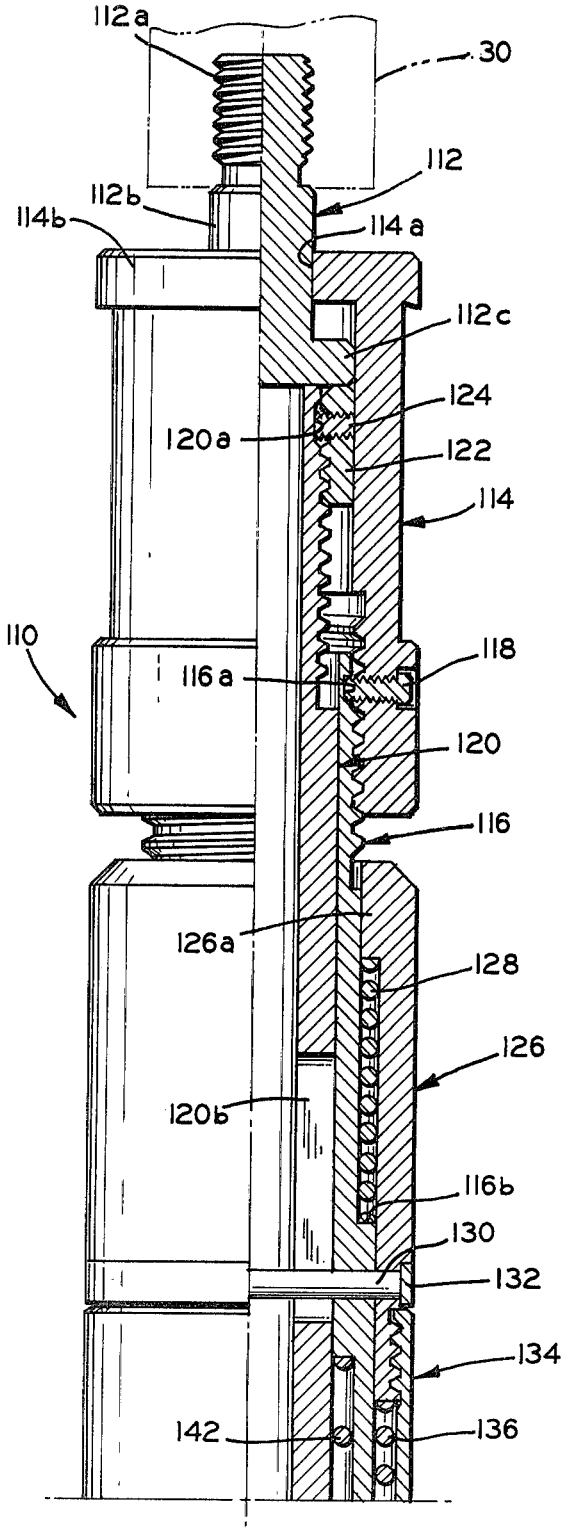
FIGS. 7*a* and 7*b* together constitute an elevational view, partly in section, illustrating a retrieving tool which is utilized to retrieve the locking device up the tubing string after the device has been locked within a landing nipple, FIG. 7*b* being a vertical continuation of FIG. 7*a*.
Figure 7B:
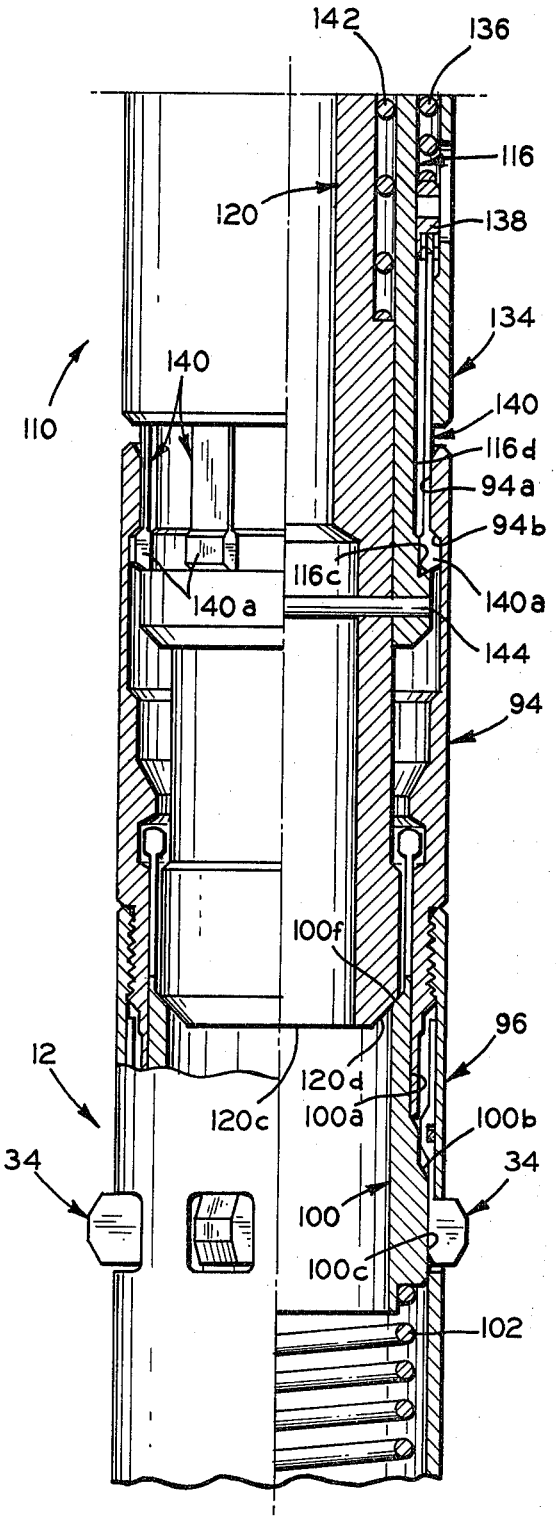

Referring to FIGS. 7*a* and 7*b*, there is shown a retrieving tool, generally indicated by numeral 110, which is utilized to retrieve the locking device 12 from the tubing string after the device has been fully locked within the landing nipple. As shown in FIG. 7*a*, the retrieving tool 110 comprises a fishing neck retainer plug 112 having an upper externally threaded portion 112*a* for attachment to the wire line jars 30. The retainer plug 112 has an intermediate cylindrical portion 112*b* which is slidably mounted within a cylindrical aperture 114*a* formed in a top wall 114*b* of a fishing neck 114. The extreme lower end of the retainer plug 112 has an enlarged shoulder portion 112*c* for retaining the plug within the fishing neck 114.

The lower end of the fishing neck 114 is threaded onto the upper end of an outer body sleeve or mandrel 116. A set screw is threaded into the side wall of the fishing neck 114 and protrudes radially inwardly into an outer groove 116*a* formed in the upper end of the outer body sleeve or mandrel 116. The set screw 118 thus locks the fishing neck 114 to outer body sleeve or mandrel 116.

A lower or inner body sleeve 120 is slidably mounted within the outer body sleeve of mandrel 116 and fishing neck 114. An annular stop ring 122 is threaded onto the upper end of the lower body 120 and is secured to the body 120 by means of a set screw 124. The set screw is threaded into the side wall of the stop ring 122 and protrudes radially inwardly into an outer groove 120*a* formed in the upper end of the lower body 120.

A cylindrical spring housing 126 circumscribes the mandrel 116 and has an inner annular shoulder 126*a* formed at the upper end thereof. The shoulder 126*a* provides an upper seat for a compressed helical spring 128. The lower seat of the spring 128 is provided by a shoulder 116*b* formed on the mandrel 116. The spring 128 exerts a downward force on the mandrel 116 relative to spring housing 126. A shear pin 130 opposes such force.

Initially, the spring housing 126 and the mandrel 116 are secured together by a diametrically positioned shear pin 130 extending through the housing 126 and the mandrel 116. A longitudinal slot 120*b* formed in the inner body sleeve 120 permits relative vertical movement of the housing 126 and the mandrel 116 with respect to the inner body 120 and, hence, constitutes a lost motion connection between the inner and outer body sleeve. A split ring 132 circumscribes the spring housing 126 to hold shear pin 130 in position.

The lower end of the spring housing 126 is threaded into a lower housing 134. A compressed helical spring 136 is positioned between the inner wall of the housing 134 and the outer wall of the mandrel 116. The upper end of the spring 136 abuts the lowermost end of the spring housing 126.

As shown in FIG. 7*b*, the spring 136 exerts a downward force on an annular dog retainer ring 138 slidably positioned between the mandrel 116 and the housing 134. The ring 138 houses the upper ends of a plurality of axially extending, circumferentially spaced apart collet fingers or dogs 140. The dogs 140 have enlarged portions 140*a* formed at their lowermost ends which rest on an annular stepped surface 116*c* formed at the lower end of the mandrel 116 below a reduced diameter portion 116*d*.

The inner wall of the mandrel 116 and the outer wall of the inner body 120 cooperate to house a compressed helical spring 142. The spring 142 exerts a downward force on the inner body 120 relative to the mandrel 116. The mandrel 116 and inner body 120 are secured together by a diametrically positioned shear pin 144 extending through the lowermost end of the mandrel 116 and into the sidewall of the body 120.

The extreme lower end of the retrieving tool 110 is represented by numeral 120*c*. The lower end of the inner body sleeve 120 has an outer tapered surface 120*d* which engages the tapered surface 100*f* of the plunger 100 of the previously described locking device 12 to move the plunger downwardly and permit the dogs 34 to retract.

OPERATION OF THE RETRIEVING TOOL

Once the locking device 12 has been locked within a landing nipple and the running tool 10 has been retrieved up the tubing, the retrieving tool 110 can be used to unlock the device 12 from the landing nipple and retrieve the device up the tubing. The fishing neck 112*a* of the tool 110 is attached to the set of jars 30 and lowered down the tubing by the wireline. When the tool 110 reaches the locking device 12, the inner body 120 is lowered into the fishing neck 94 until the enlarged portions 140*a* of the dogs 140 abut the upper lip of the inner shoulder 94*a*. Further downward movement of the tool 110 causes the enlarged portions 140*a* to move upwardly off the stepped surface 116*c* and then collapse inwardly against the reduced diameter portion 116*d* immediately above the surface 116*c*. The enlarged portions 140*a* can then be lowered into the fishing neck until they expand to engage the lower lip 94*b* of the inner shoulder 94, as shown in FIG. 7*b*. The retrieving tool 110 is now secured to the locking device 12.

Now, the plunger 100 must move downwardly to permit the dogs 34 to move from a fully expanded position, as shown in FIG. 7*b*, to a fully retracted position. This step is accomplished by jarring down on the fishing neck retainer plug 112 to exert a downward force on the inner body 120 and shear the shear pin 144 at a location which permits the body 120 to slide within the outer body or mandrel 116. Once the pin 144 is sheared, the spring 142 exerts a downward force on the inner body 120. The outer tapered surface 120*d* engages the tapered surface 100*f* of the plunger 100 to force the plunger downwardly. The plunger 100 is moved downwardly until the dogs 34 are resting on the first stepped surface 100*a*. At this time, the dogs 34 are free to fully retract and the locking device 12 can be retrieved up the tubing. Upward movement of outer body sleeve 116 is transmitted to inner body sleeve 120 thru the lost motion connection of pin 130 with slot 120*b*.

In some instances, it may be impossible to move the dogs 34 to a retracted position once the retrieving tool 110 has been secured to the locking device 12 and an upward force applied to device 12. Under these circumstances, the retrieving tool 110 may be released from the locking device 12 by jarring up on the fishing neck 114 to exert an upward force on the mandrel 116. This causes the shear pin 130 to shear between mandrel 116 and housing 166, which permits the compressed spring 128 to move the mandrel 121 downwardly within the housing 126 and disengage the enlarged portions 140*a* of the dogs 140 from the fishing neck 94. Slot 120*b* permits such downward movement of the unsheared portion of pin 130. The tool 110 can then be retrieved up the tubing, while leaving the locking device 12 downwhole.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A lock for securing a well tool in a selected one a plurality of landing nipples in a well conduit, each said nipple defining an internal shoulder of diameter less than the conduit bore and an annular locking recess above the shoulder having a diameter greater than the conduit bore, comprising: an annular housing having a plurality of circumferentially spaced windows; a plurality of axially extending locking dogs having enlarged portions respectively aligned with and entering said windows; means in said housing for shiftably mounting said dogs to permit said enlarged portions to move through said windows to project radially beyond said housing; a camming sleeve axially slidably mounted within said housing and having a series of axially spaced, external cylindrical cam surfaces selectively engagable with the inner surfaces of said dogs, said cam surfaces increasing in diameter downwardly, whereby relative upward movement of said camming sleeve will radially shift the locking dog ends successively from a fully retracted position, to a partially projecting no-go position, and then to a fully projecting locking position, the effective maximum diameter of said locking dog ends in said no-go position being greater than said internal shoulder diameter but less than the conduit bore diameter; resilient means urging said camming sleeve upwardly, the top portions of said camming sleeve defining a plurality of peripherally spaced, resilient fingers having enlarged end portions; said enlarged finger end portions being arranged for detachable engagement by a running tool to successively shift the vertical position of said camming sleeve relative to said locking dogs from said fully retracted position, to said partially retracted position and then to said fully projecting position upon successive relative upward movements of said running tool.

2. The lock of claim 1 wherein said annular housing has an inner annular groove formed therein for receiving said enlarged finger end portions when said camming sleeve is in a locked position relative to said locking dogs.

3. The lock of claim 1 further comprising a downwardly facing shoulder on the upper portion of said annular housing; a retrieving tool for unlocking and removing the secured housing, said retrieving tool having: a downwardly facing shoulder on its lower end to engage and depress said camming sleeve to its retracted position relative to said locking dogs; an annular recess receiving said enlarged finger end portions; and a plurality of peripherally spaced collet fingers engageable with said downwardly facing shoulder of said annular housing to pull said annular housing out of the well.

4. The lock of claim 3 wherein said retrieving tool comprises: an inner body sleeve defining said downwardly facing shoulder and said recess; an outer body sleeve surrounding the upper portions of said inner body sleeve; biasing means mounted between said inner and outer body sleeves; shearable means connecting said body sleeves and initially locking said sleeves against relative axial movements; a biasing housing surrounding said outer body sleeve and defining an annular chamber for receipt of said biasing means; an annular collet finger anchor axially slidably mounted in said annular chamber and supporting said collet fingers for radial movements relative to said outer body sleeve, whereby the lower ends of said collet fingers may be cammed inwardly to pass the shoulder on the upper portion of the annular housing to engage said downwardly facing shoulder; an upwardly facing shoulder on said outer body sleeve concurrently engaging the ends of said collet fingers to lock said outer body sleeve to said annular housing by interengagement with said collet finger ends, whereby a downward force may be applied to said inner body sleeve to shear said shearable means and permit said inner body sleeve to move downwardly to shift said camming sleeve to said retracted position, thereby releasing the locking dogs and permitting pulling of said annular housing.

5. The lock of claim 3 wherein said retrieving tool comprises: an inner body sleeve defining said downwardly facing shoulder and said recess; an outer body sleeve surrounding the upper portions of said inner body sleeve and having an internal flange overlying the top portion of said inner body sleeve; biasing means between said inner and outer body sleeve; shearable means connecting said body sleeves and initially locking said sleeves against relative axial movements; a biasing means housing surrounding said outer body sleeve and defining an annular chamber; an annular collet finger anchor axially slidably mounted in said annular chamber and supporting said collet fingers for radial movements relative to said outer body sleeve, whereby the lower ends of said collet fingers may be cammed inwardly to pass the shoulder on the upper portion of the annular housing to engage said downwardly facing shoulder; an upwardly facing shoulder on said outer body sleeve concurrently engaging said collet ends to lock said outer body sleeve to said annular housing by interengagement with said collet finger ends whereby a jarring force may be applied to shear said shearable means and permit said inner body sleeve to move downwardly to shift said camming sleeve to its said retracted position, thereby releasing the locking dogs and permitting pulling of said annular housing; jar means for effecting said jarring force and including a shoulder disposed beneath said internal flange to transmit a lifting load to said outer body sleeve; and lost motion means interconnecting said inner and outer body sleeves for lifting said inner body sleeve.

6. The lock of claim 5 wherein said lost motion means comprises a radial pin traversing a hole in said outer body sleeve and a vertical slot in said inner body sleeve.

7. The lock of claim 4 further comprising a second biasing means between said biasing housing and said outer sleeve; and a second shearable means traversing said biasing housing, said outer body sleeve and a vertically extending slot in said inner body sleeve, thereby permitting said downward movement of said inner body sleeve while maintaining said second biasing means in a bias transmitting position, said second shearable means being shearable by an upward jarring force on said outer body sleeve if said locking dogs fail to retract, whereby said outer body sleeve is shifted downwardly by said second biasing means to release said collet fingers from said annular housing to effect recovery of the retrieving tool.

8. The lock of claim 5 wherein said jar means includes a retainer plug having an enlarged head portion disposed between the top of said inner body sleeve and said internal flange of said outer body sleeve.

9. An apparatus for securing a well tool in a selected one of a plurality of landing nipples in a tubing string, each said nipple defining an internal shoulder of diameter less than the tubing bore and an annular locking recess above the shoulder having a diameter greater than the tubing bore, comprising: a locking mechanism including a primary annular housing, said housing having a plurality of circumferentially spaced windows; a plurality of axially extending locking dogs having enlarged portions respectively aligned with and entering said windows; means in said primary housing for shiftably mounting said dogs to permit said enlarged portions to move through said windows to project radially beyond said housing; a camming sleeve axially slidably mounted within said housing and having three axially spaced, external cylindrical cam surfaces selectively engageable with the inner surfaces of said dogs, said cam surfaces increasing in diameter downwardly, whereby upward movement of said camming sleeve relative to said dogs will radially shift the locking dog ends successively from a fully retracted position, to a partially projecting no-go position and then to a fully projecting locking position; the effective maximum diameter of said locking dog ends in said no-go position being greater than said internal shoulder diameter but less than the tubing bore diameter; resilient means urging said camming sleeve upwardly, the top portions of said camming sleeve defining a plurality of peripherally spaced, resilient fingers having enlarged end portions; a running tool including an upper fishing neck portion; a lower body portion insertable within said camming sleeve and limiting upward movement thereof; an annular recess on said lower body portion engageable with said finger end portions; wire line actuated jar means connected to said fishing neck portion; and means interconnecting said fishing neck portion and said lower body portion and responsive to upward jarring force to first pull said camming sleeve upwardly by said fingers to said no-go position, then responsive to downward jarring force followed by upward movement of the running tool to pull said camming sleeve upwardly to said locking position and concurrently to release said enlarged finger ends from said lower body recess to permit pulling of said running tool.

10. The apparatus of claim 9 further comprising a unidirectional ratchet housing surrounding the upper portions of said running tool; means providing a lost motion connection between said ratchet housing and said fishing neck; a detent mounting ring axially slidable on said ratchet housing; spring means urging said detent mounting ring downwardly; a plurality of resilient, radially deflectable detents mounted on said ring and engageable with said nipple internal shoulder in their outer positions; an annular cam means of limited axial extent on said ratchet housing normally holding said detents in their outer position, whereby said detents are deflected upwardly and inwardly by downward engagement with each said nipple internal shoulder to ratchet past each nipple, but effect a locking engagement with said nipple internal shoulder upon upward movement of the running tool relative to any nipple.

11. The apparatus of claim 10 further comprising shearable stop means for limiting axial displacement of said detent mounting ring relative to said cam means, said stop means being shearable by upward jarring forces applied to said fishing neck portion, thereby permitting said annular cam means to move upwardly past said detents to permit emergency upward passage thru all nipples.

12. The apparatus of claim 10 wherein said running tool includes an inner positioning sleeve connected to said fishing neck at its top end by a lost motion connection and having its lower end connected to said lower body portion, the medial portion of said positioning sleeve having radially deflectable collet projections; and means for retaining said camming sleeve in said retracted position for running in of the apparatus comprising: a spring housing surrounding said positioning sleeve and abutting the top of said primary housing, and a plurality of radially inwardly projecting locating pins traversing said spring housing and cooperating with said collet projections to yieldably limit upward movement of said positioning sleeve.

13. The apparatus of claim 12 wherein the connection between said inner positioning sleeve and said lower body portion comprises a shearable means traversing said positioning sleeve and said lower body portion whereby if said lower body is unable to pull said camming sleeve upwardly to said fully locked position, upward jarring forces applied to said positioning sleeve severs said shear means to disconnect said positioning sleeve and said lower body to permit retrieval of all of the running tool except said lower body portion.

14. The apparatus of claim 12 wherein said primary housing has a downwardly facing shoulder adjacent its upper end; a mandrel sleeve secured to the lower poriton of said ratchet housing; a compressed spring disposed between said mandrel sleeve and said spring housing urging said mandrel sleeve downwardly and said spring housing upwardly; a shear member traversing said mandrel sleeve and said spring housing, the bottom portions of said mandrel sleeve defining an upwardly facing shoulder inwardly spaced from said downwardly facing shoulder of said primary housing, thereby defining an annular locking recess between said shoulders; and means for mounting a collet on the lower end of said spring housing, said collet having enlarged locking ends disposed in said locking recess, whereby said locking device is locked to said running tool until the severance of said shear means permits limited upward movement of said inner positioning sleeve relative to said primary housing.

15. The apparatus as defined in claims 9, 10, 11, 12, 13 or 14 wherein said primary annular housing has a cylindrical wall opposite and above said enlarged finger end portions to prevent movement of said finger end portions out of said annular recess on said lower body portion as said lower body portion pulls said camming sleeve upwardly to said fully locked position, and an annular recess at the top of said cylindrical wall to receive said finger end portions when the locking device is fully locked, thereby releasing the running tool from the locking device.

16. A method of emplacing a locking device, having radially shiftable locking dogs, in a conduit of a subterranean well, comprising the steps of:

(1) providing on the conduit a nipple means having a lower restricted portion with an internal diameter less than the diameter of the conduit and a recessed portion located above said lower restricted portion;

(2) providing the conduit with an upper restricted portion located above said nipple means and having an internal diameter less than the diameter of the conduit;

(3) lowering through the conduit, a running tool carrying said locking device with the locking dogs disposed in a retracted position until the tool is positioned at a depth intermediate said upper and lower restricted portions, the running tool having ratcheting means passing said restricted portions only in downward movement of the tool;

(4) pulling said running tool and said locking device upwardly until said running tool ratchet means engages said upper restricted portion;

(5) moving a portion of the running tool upwardly to set said locking dogs in a no-go position protruding outwardly to define an outside diameter greater than the internal diameter of said restricted portion and less than the internal diameter of the tubing string;

(6) lowering said running tool and said locking device down the tubing until said locking dogs encounter said lower restricted portion of said nipple means; and (7) expanding said locking dogs outwardly into said recessed portion to a locked position wherein said locking dogs define an outside diameter greater than the internal diameter of said lower restricted portion.

17. A method of emplacing a locking device, having radially shiftable locking dogs, in a tubing string of a subterranean well, comprising the steps of:

(1) providing in the tubing string a nipple means having a lower restricted portion with an internal diameter less than the diameter of the tubing and a recessed portion located above said lower restricted portion; p1 (2) providing the tubing string with an upper restricted portion located above said nipple means and having an internal diameter less than the diameter of the tubing;

(3) lowering through the tubing string, a running tool carrying said locking device with the locking dogs disposed in a retracted position until the tool is positioned at a depth intermediate said upper and lower restricted portions, the running tool having ratcheting means passing said restricted portions only in downward movement of the tool;

(4) pulling said running tool and said locking device upwardly until said running tool ratchet means engages said upper restricted portion;

(5) moving a portion of the running tool upwardly to set said locking dogs in a no-go position protruding outwardly to define an outside diameter greater than the internal diameter of said restricted portion and less than the internal diameter of the tubing string;

(6) lowering said running tool and said locking device down the tubing until said locking dogs encounter said lower restricted portion of said nipple means;

(7) expanding said locking dogs outwardly into said recessed portion to a locked position wherein said locking dogs define an outside diameter greater than the internal diameter of said lower restricted portion; and (8) concurrently with or subsequent to step (7) releasing the running tool from the locking device.

18. A method of emplacing a locking device having radially shiftable locking dogs in a selected one of a plurality of landing nipples positioned along a tubing string of a subterranean well, each of said nipples having a lower restricted portion with an internal diameter less than the diameter of the tubing and a recessed portion located above said lower restricted portion having an internal diameter greater than the tubing diameter, the method comprising the steps of:

(1) lowering through the tubing string, a running tool carrying said locking device with the locking dogs disposed in a retracted position until the tool has passed through the restricted portion of the nipple located immediately above the selected nipple, the running tool having ratcheting means passing the restricted portions of each nipple only in downward movement of the tool;

(2) pulling said running tool and said locking device upwardly until said running tool ratchet means engages the restricted portion of the nipple immediately above the selected nipple;

(3) moving a portion of the running tool upwardly to set said locking dogs in a no-go position protruding outwardly to define an outside diameter greater than the internal diameter of said restricted portion of the selected nipple and less than the internal diameter of the tubing string;

(4) lowering said running tool and said locking device down the tubing until said locking dogs encounter the restricted portion of the selected nipple; and (5) applying downward jarring forces to expand said locking dogs outwardly into the recessed portion of the selected nipple to a locked position wherein said locking dogs define an outside diameter greater than the internal diameter of the restricted portion of the nipple.

19. A method of emplacing a locking device having radially shiftable locking dogs in a selected one of a plurality of landing nipples positioned along a tubing string of a subterranean well, each of said nipples having a lower restricted portion with an internal diameter less than the diameter of the tubing and a recessed portion located above said lower restricted portion having an internal diameter greater than the tubing diameter, the method comprising the steps of:

(1) lowering through the tubing string, a running tool carrying said locking device with the locking dogs disposed in a retracted position until the tool has passed through the restricted portion of the nipple located immediately above the selected nipple, the running tool having ratcheting means passing the restricted portions of each nipple only in downward movement of the tool;

(2) pulling said running tool and said locking device upwardly until said running tool ratchet means engages the restricted portion of the nipple immediately above the selected nipple;

(3) moving a portion of the running tool upwardly to set said locking dogs in a no-go position protruding outwardly to define an outside diameter greater than the internal diameter of said restricted portion of the selected nipple and less than the internal diameter of the tubing string;

(4) lowering said running tool and said locking device down the tubing until said locking dogs encounter the restricted portion of the selected nipple;

(5) applying downward jarring forces to expand said locking dogs outwardly into the recessed portion of the selected nipple to a locked position wherein said locking dogs define an outside diameter greater than the internal diameter of the restricted portion of the nipple; and (6) concurrently with or subsequent to step (5) releasing the running tool from the locking device.

20. A method of emplacing a selective locking device in a well conduit having thereon a plurality of nipples disposed at preselected intervals along the length of the conduit, each nipple providing a suitably configured seat for mating engagement by radially projectable locking dog means of the locking device and a common diameter seal bore providing an engageable restriction in the conduit bore, which restriction has an internal diameter less than the nominal diameter of the conduit bore and is disposed below the seat location in the nipple, said method comprising the steps of:

(1) running the locking device on a running tool through said conduit to a selected one of a plurality of nipples, the locking dog means of the locking device being in a retracted position;

(2) shifting the running tool upward to engage externally projecting collet means thereon with the restricted bore portion of the nipple immediately above the nipple in which the locking device is to be set;

(3) applying additional upward force to the running tool to effect shifting of the locking dog means to a no-go position relative to the bore restriction;

(4) thereafter running the running tool downwardly in said well casing to the nipple in which the locking device is to be set with the locking dog means of the locking device protruding partially outwardly in the no-go position to engage the seal bore restricted portion;

(5) shifting the locking device to fully engage the locking dog means in the nipple seat by application of downward jarring forces to said device;

(6) concurrently disengaging the running tool from the locking device after seating of the locking dog means in the selected nipple; and (7) withdrawing the running tool from the well casing.

* * * * *